US005165531A

United States Patent [19]

Kawakami et al.

[11] Patent Number: 5,165,531

[45] Date of Patent: Nov. 24, 1992

[54] TRIGGER SWITCH

[75] Inventors: Makoto Kawakami, Shimane; Takeshi Kikukawa, Izumo, both of Japan

[73] Assignee: Omron Corporation, Kyoto, Japan

[21] Appl. No.: 595,462

[22] Filed: Oct. 10, 1990

Related U.S. Application Data

[63] Continuation of Ser. No. 507,205, Apr. 10, 1990, abandoned.

[30] Foreign Application Priority Data

Apr. 10, 1989 [JP] Japan ..... 1-88135
Apr. 10, 1989 [JP] Japan ..... 1-88136

[51] Int. Cl.[5] ..... H01H 13/70; H01H 3/04
[52] U.S. Cl. ..... 200/343; 200/335
[58] Field of Search ..... 200/343, 522, 335, 302.3, 200/339

[56] References Cited

U.S. PATENT DOCUMENTS 3,654,416 4/1972 Cherry et al. ..... 200/302.3
3,713,670 1/1973 Reynolds ..... 200/168.6
3,725,626 4/1973 Kruse ..... 200/168.6

FOREIGN PATENT DOCUMENTS 1465705 1/1970 Denmark .
1223443 1/1973 Denmark .

*Primary Examiner*—Ernest G. Cusick
*Assistant Examiner*—David J. Walczak
*Attorney, Agent, or Firm*—Fish & Richardson

[57] ABSTRACT

A trigger switch for hand-held electric power tools in which an actuating arm for actuating a switch mechanism is pivotally supported in a case by way of a pivot shaft pivotally supported by a pair of parallel lateral walls defining the case, and a trigger member having a front end and a pair of lateral flanges is pivotally supported by the case in a coaxial relationship with the pivot shaft by way of the lateral flanges. By securely coupling an extension of the pivot shaft with one of the flanges, the switch mechanism internally accommodated in the case can be actuated by operating the trigger member. Since the switch mechanism is internally accommodated in the case, a considerable saving of space can be accomplished. Since the coupling between the pivot shaft and the trigger member can be accomplished by the extension of the pivot shaft passed through the case by way of a round opening provided in the case, sealing of the switch mechanism can be easily accomplished.

4 Claims, 2 Drawing Sheets

TRIGGER SWITCH

REFERENCE TO RELATED APPLICATION

This application is a continuation of application Ser. No. 07/507,205, filed Apr. 10, 1990, now abandoned.

TECHNICAL FIELD

The present invention relates to a trigger switch for hand-held electric power tools.

BACKGROUND OF THE INVENTION

Conventionally, a trigger switch for hand-held electric power tools, as illustrated in FIG. 4, consisted of a switch unit having a push-button member 4 projecting out of a case 3, and a trigger member 1 pivotally supported by the case 3 by means of a pivot shaft 2 and adapted to bear upon the push-button member 4 when it is actuated or, in other words, pulled by a finger. According to this structure, since the push-button member 4 projects out of the case 3, and the trigger member 1 acts upon the free end of the push-button member 4, it has been difficult to achieve a compact design of the trigger switch. Also, the need for a push-button switch means a high cost not only for the component parts themselves but also for assembling them. Furthermore, since the push-button member moves into and out of the case, it has been difficult to achieve a satisfactory sealing of the switch mechanism which is coupled to the push-button member. Additionally, the use of such a push-button mechanism requires a relatively large force to be applied to the trigger member for its operation.

BRIEF SUMMARY OF THE INVENTION

In view of such problems of the prior art, a primary object of the present invention is to provide a trigger switch for hand-held electric power tools which is compact in size.

A second object of the present invention is to provide a trigger switch which requires a relatively small force for its operation.

A third object of the present invention is to provide a trigger switch which permits sealing of its switch mechanism to be easily accomplished.

A fourth object of the present invention is to provided a trigger switch which is economical to manufacture.

According to the present invention, these and other objects can be accomplished by providing a trigger switch, comprising: a case accommodating a switch mechanism therein and having a pair of parallel lateral walls; a pivot shaft extending across the lateral walls and pivotally supported by the lateral walls; an actuating arm integrally attached to the pivot shaft and adapted to actuate the switching mechanism when the pivot shaft is rotated around its central axial line along with the actuating arm; and a trigger member having a front end, and a pair of flanges extending from either side of the front end in mutually parallel relationship and pivotally supported by the casing around a pivot axis coaxial with the pivot shaft; one end of the pivot shaft extending laterally from one of the lateral walls of the case and integrally coupled with one of the flanges of the trigger member.

Thus, since the switch mechanism is incorporated in the case, a compact design is made possible. Since the coupling between the pivot shaft and the trigger member can be accomplished by an extension of the pivot shaft which may include a part having a round cross section rotatably received in a round opening of a wall portion of the case, sealing of the interior of the case can be accomplished in a simple manner as compared with a conventional trigger switch using a push-button member moving into and out of the case.

The integral coupling between one of the flanges and the extension of the pivot shaft may be accomplished by fitting a part of the extension having a non-circular cross section into an opening having a complementary shape provided in one of the flanges. If the other end of the pivot shaft is simply received in a cavity defined in the inner side of the associated one of the parallel walls, an even more favorable sealing result can be obtained as opposed to the case in which the two ends of the pivot shaft are both rotatably received in openings completely passed through the lateral walls of the case.

BRIEF DESCRIPTION OF THE DRAWINGS

Now the present invention is described in the following in terms of a specific embodiment with reference to the appended drawings, in which.

DETAILED DESCRIPTION OF THE PREFERRED EMBODIMENT(S)

Figure 1:
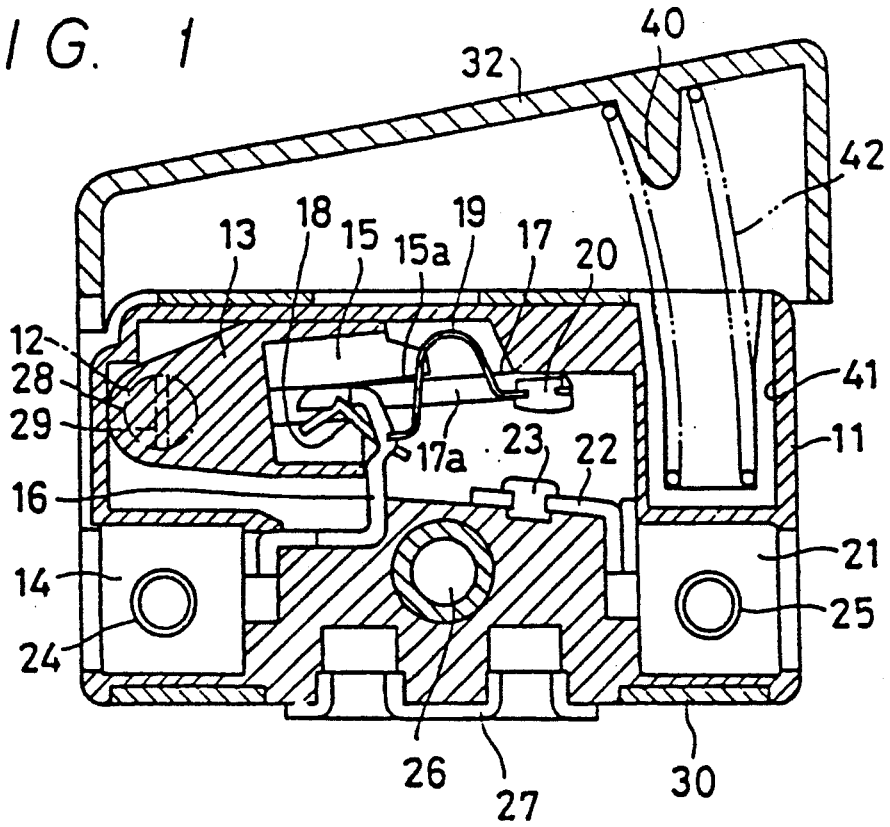
FIG. 1 is a sectional front view of an embodiment of the trigger switch according to the present invention.
Figure 2:
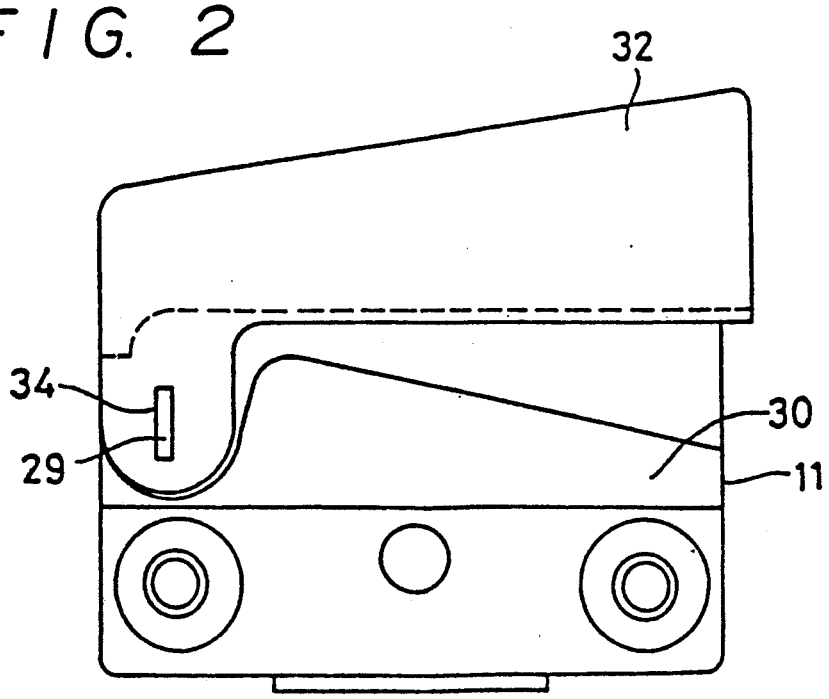
FIG. 2 is a front view of the trigger switch.

FIG. 1 shows an embodiment of the trigger switch according to the present invention, and FIG. 2 is a front view showing its external appearance.

A case 11 made of synthetic resin accommodates therein an operation arm 13 which is securely attached to a pivot shaft 12 rotatably supported by two lateral walls of the case 11 and is adapted to be actuated by a trigger member 32 pivotally supported by the case 11 in a coaxial relationship with the pivot shaft 12 as described hereinafter. The case 11 may consist of a part of the grip of a hand-held electric power tool, or may be adapted to be mounted inside such a grip. A first terminal piece 14 is fixed to a part of the case 11 near the pivot shaft end of the operation arm 13, and an engagement piece 16 integrally extends from the first terminal piece 14 into a cavity 15 defined in the operation arm 13.

A free end of this engagement piece 16 pivotally supports a base end of a movable piece 17 by way of a metallic receiving member 18. A moveable spring 19 is interposed between a front edge of an opening **17*a* provided substantially in a middle part of the moveable piece 17 and the engagement piece 16 in a curved fashion, with the convex surface of the moveable spring 19 facing the front part (the upper part as seen in FIG. 1) of the case 11 so that the base end of the moveable piece 17 may be engaged by the metallic receiving member 18. A moveable contact 20 is fixedly attached to a free end of the moveable piece 17**.

This support structure is similar to that of a normal micro switch. It is possible to use switch mechanisms of other kinds without departing from the spirit of the present invention as long as they may be conveniently accommodated within the case 11.

Opposite to the moveable contact 20 is located a fixed contact 23 which is fixedly secured to a free end of a fixed piece 22 integrally extending from a second terminal 21. Numerals 24 and 25 denote screw holes for securing lead wire ends to the terminals 14 and 21, respectively, numeral 26 denotes a switch mounting hole for securing the switch in the grip of a hand-held electric power tool, and numeral 27 denotes an intermediate terminal.

Figure 3:
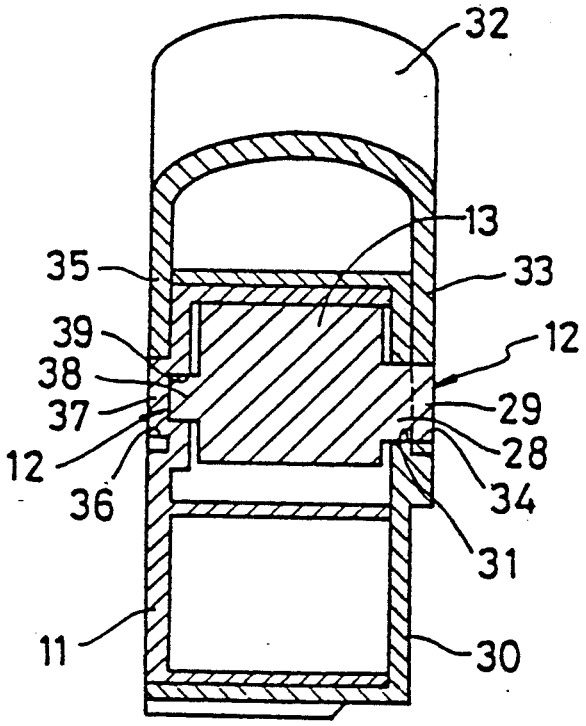
FIG. 3 is a schematic sectional side view of the trigger switch.
Figure 4:
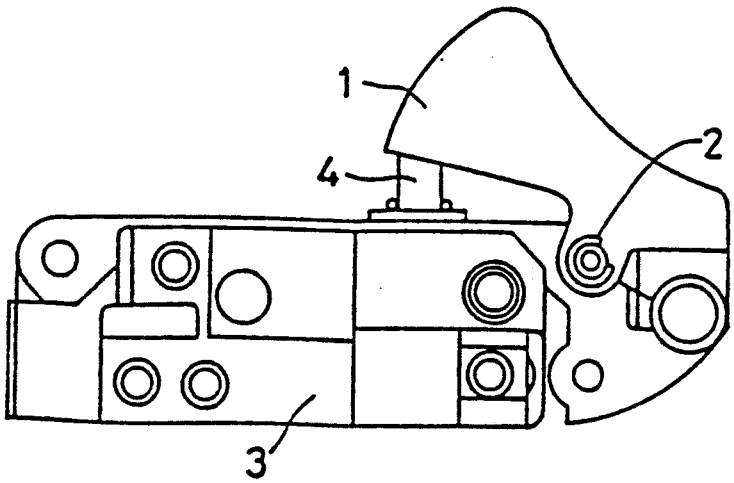
FIG. 4 is a front view of a related art trigger switch.

The pivot shaft 12 includes an extension on one side of the operation arm 13 which consists of a first part 28 having a circular cross section and second part 29 extending from the free end of the first part and provided with a non-circular cross section by being cut along its two sides in a parallel fashion. The first part 28 having a circular cross section is rotatably fitted into a round hole 31 of a cover 30 closing a front opening of the case 11 so as to define a complete case as shown in FIG. 3, and the second part 29 having a rectangular cross section is securely fitted into a rectangular hole 34 formed in one of a pair of lateral flanges 33 of the trigger member 32 which straddle across an assembly consisting of the case 11 and the cover 30 so as to be rotatable integrally therewith. The other of the two flanges 35 of the trigger member 32 is provided with a round hole 36 which is coaxial with and conformal to the other round hole 31, and a hollow pin 37 having a circular cross section and projecting from the other side of the case 11 coaxially with the pivot shaft 12 is rotatably received in this round hole 36 of one of the flanges of the trigger member 32. Another small round pin 38 projecting from the other side of the operation arm 13 as a second extension of the pivot shaft 12 is rotatably received in a small round hole 39 formed in the inner side of the hollow pin 37 of the case 11.

As shown in FIG. 1, a compression coil spring 42 is interposed between a boss 40 projecting from the inner side of the front end of the trigger member 32 and a cavity 41 formed in the front end of the case 11 so as to urge the trigger member 32 away from the front face of the case 11 around the pivot shaft 12.

Now, the mode of operation of this trigger switch is described in the following.

Referring to FIG. 1, when the trigger member 32 is depressed against the force of the spring 42 by a finger, the operation arm 13 rotates in the same direction (in clockwise direction in FIG. 1) by way of the rectangular second part 29 of the pivot shaft extension, and a front edge 15*a* of the cavity 15 presses upon the moveable piece 17. Once the moveable piece 17 goes over a certain critical point, the direction of the urging force of the moveable spring 19 acting upon the moveable piece 17 is reversed, and the moveable contact 20 comes into contact with the fixed contact 21 under the spring force of the moveable spring 19 with the result that an electric signal is obtained from the first terminal piece 14 and the second terminal piece 21. When the pressure upon the trigger member 32 is removed, the trigger member 32 is restored to its original position by the restoring force of the spring 42 along with the operation arm 13 so that the moveable piece 17 returns to its original position under the restoring force of the movable spring 19, and the moveable contact 20 is removed away from the fixed contact 23.

The integral coupling between the trigger member 32 and the operation arm 13 in the case 11 is accomplished by fitting the rectangular second part 29 into the rectangular hole 34 on the one hand and fitting a round first part 28 into the round hole 31 of the case 11 on the other hand, with the small pin 38 of the pivot shaft 12 being engaged with the trigger member 32 indirectly by way of the hollow pin 37 of the case 11, as shown in FIG. 3. According to this structure, since no part of the pivot shaft 12 is completely and directly passed through the other round hole 39 of the case 11 or other part of the corresponding flange of the trigger member 32, a favorable sealing can be accomplished.

Obviously, the engagement between the trigger member 32 and the operation arm 13 may be accomplished by non-circular parts thereof, such as a rectangular part 29 and a rectangular hole 34. Also, it is possible to provide a pair of round shafts projecting from either side of the operation arm 13, pass them through round holes provided in the case 11 and the cover 30, and crimp, press fit or otherwise secure their free ends in the holes of the trigger member 32. Screws and other securing means may also be used.

Further, as a switch mechanism for use in the case 11, a throw-type switch which directly acts upon an elastic moveable piece may also be used instead of the snap action mechanism used in the illustrated embodiment.

Thus, according to the trigger switch of the present embodiment, since it comprises a trigger member pivotally supported by a case at its one end and urged rotatably away from the case, an operation arm received in the case so as to be integrally rotatable with the trigger member by way of a pivot shaft, a moveable piece which is displaced by the rotation of the operation arm, a moveable contact attached to a free end of the moveable piece, and a fixed contact mounted on the case opposite to the moveable contact, the integral coupling between the pivot shaft of the operation arm and the trigger member is simplified, and, owing to the fact that the entire switch mechanism along with the actuating arm coupled to the trigger member by way of a pivot shaft is located within the case, both compact design and light operating load can be accomplished at the same time. Further, since there is no slide member projection out of the case, a favorable sealing effect can be accomplished, and a cost reduction can be easily accomplished through simplification of sealing requirements.

Although the present invention has been shown and described with respect to detailed embodiment, it should be understood by those skilled in the art that various changes and omission in form and detail may be made therein without departing from the spirit or scope of this invention.

What we claim is:

1. A trigger switch, comprising:

a case accommodating a switch mechanism therein and having a pair of parallel lateral walls;

a pivot shaft extending across said lateral walls and pivotally supported by said lateral walls;

an actuating arm integrally attached to said pivot shaft and adapted to actuate said switching mechanism when said pivot shaft is rotated around its central axial line along with said actuating arm;

a trigger member having a front end, and a pair of flanges extending from either side of said front end in mutually parallel relationship and pivotally supported by said casing around a pivot axis coaxial with said pivot shaft;

one end of said pivot shaft extending laterally from one of said lateral walls of said case and integrally coupled with one of said flanges of said trigger member, and wherein one of two ends of said pivot shaft is rotatably received in a cavity defined in an inner side of one of said lateral walls of said case, and the other of its two ends it rotatably passed through a round hole formed in the other of said lateral walls of said case, an extension of said other end of said pivot shaft being coupled to one of said flanges of said trigger member for integral rotation therewith.

2. A trigger switch according to claim 1, wherein a projection having a round cross section projects integrally from an outer side of said one of said lateral walls coaxially and opposite to said cavity, and an inner side of an associated one of said flanges is provided with another cavity which is pivotally fitted upon said projection.

3. A trigger switch according to claim 1, wherein said extension of said pivot shaft is provided with a non-circular cross section, and a corresponding part of a corresponding one of said flanges is provided with an opening which is complementary with said non-circular extension.

4. A trigger switch according to claim 1, wherein said pivot shaft is pivotally supported by said lateral wall adjacent one end thereof.

* * * * *